United States Patent [19]

Irving

[11] Patent Number: 4,868,987

[45] Date of Patent: Sep. 26, 1989

[54] PRECISION HAIR STYLING SHEARS

[76] Inventor: Joe R. Irving, 1710 Carousel Cir., Columbia, S.C. 29203

[21] Appl. No.: 211,908

[22] Filed: Jun. 27, 1988

[51] Int. Cl.[4] ..... B26B 19/00

[52] U.S. Cl. ..... 30/200; 30/233

[58] Field of Search ..... 30/200, 210, 233, 194, 30/223

[56] References Cited

U.S. PATENT DOCUMENTS

| | | | |
|---|---|---|---|
| 4,054,991 | 10/1977 | Bahr | 30/233 |
| 4,428,124 | 1/1984 | Asakura | 30/233 |
| 4,520,565 | 6/1985 | Maggiure | 30/233 |

*Primary Examiner*—Frank T. Yost
*Assistant Examiner*—Willmon Fridie, Jr.
*Attorney, Agent, or Firm*—Michael A. Mann

[57] ABSTRACT

An improvement in precision hair styling shears comprises an enlarged extension of the tip of one shear, drilled and threaded to receive a post having a threaded end and a smooth end. The smooth end of the post rests on the scalp of the person whose hair is to be cut to steady and elevate the blades of the shears. A series of different length posts, or one post having a longer threaded region for advancing more or less as desired through the hole in the shears tip extension, allows adjustment of the distance from the scalp to the shears.

3 Claims, 1 Drawing Sheet

PRECISION HAIR STYLING SHEARS

BACKGROUND OF THE INVENTION

1. Field of the Invention

The invention relates to shears for cutting hair and, more particularly, to improvements in shears for precision hair styling.

2. Discussion of Background and Prior Art

Most hair styling is done with ordinary barbering shears or clippers. The barber or hair stylist measures the distance from the scalp by eye, and, holding a lock of hair with one hand and the clippers steady with the other, makes the cut. The cut is only as good as the stylist's eye and the steadiness of his hands.

U.S. Pat. No. 4,428,124 issued to Asakura discloses a device attachable to an otherwise ordinary pair of shears for assisting the making of a cut at the proper distance and angle. The device attaches to the handle portion of one of the shears and has a dependent, adjustable, scalp-engaging leg for fixing the distance between the scalp and the cut and a circular dial with a gravity-responding needle to indicate the angle at which the shears are being held.

Kelley's bubble level gauges carried by the handle and blades of a pair of shears (U.S. Pat. No. 4,215,474) and Maggiore's hair cutting guide (U.S. Pat. No. 4,520,565) are illustrative of other devices for precision cutting.

BRIEF SUMMARY OF THE INVENTION

It is an object of the invention to provide a simple apparatus for precision hair cutting.

It is a further object of the invention to provide a means for making a cut at a chosen distance from the scalp of the person whose hair is to be cut.

It is an object of the invention to provide a means for steadying the tip of the shears at the chosen distance from the scalp.

It is a further object of the invention to provide a means for quickly and easily changing the chosen distance from the scalp to shears.

To achieve the foregoing and other objects and in accordance with the purpose of the invention, as embodied and broadly described herein, the invention involves an improvement in shears for cutting and styling hair comprising a post depending from an extension of the tip of one of the two shears. Into the extension is bored a hole, tapped with coarse threads, its edges beveled for receiving the threaded end of the post. The other, smooth end of the post rests gently on the scalp of the person whose hair is to be cut. Resting on the scalp, the post elevates and steadies the tip of the shears for a precise cut at the chosen distance from the scalp. A plurality of different length posts are used for different length cuts or, alternatively, a post with a longer threaded end can be advanced through the threaded hole, then tightened with a wing nut, to change the distance from shears to scalp.

Reference is now made in detail to the present preferred embodiment of the invention, an example of which is illustrated in the accompanying drawings.

BRIEF DESCRIPTION OF THE DRAWINGS

The accompanying drawings, which are incorporated in and form a part of the specification, illustrate the invention and, together with the description, serve to explain the principles of the invention. In the drawing.

DETAILED DESCRIPTION OF A PREFERED EMBODIMENT

Figure 4:
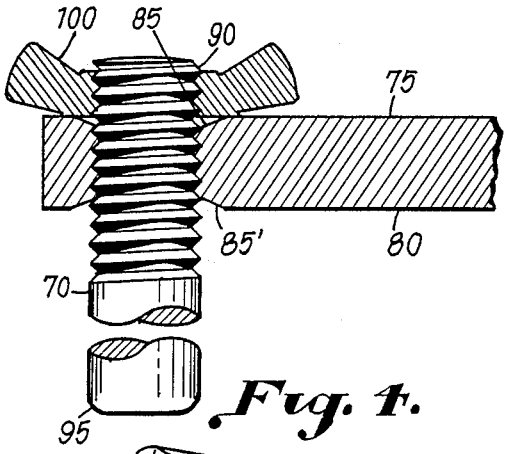
FIG. 4 is an alternative embodiment shown in a detailed cross-sectional view along line 3—3 of FIG. 2.
Figure 3:
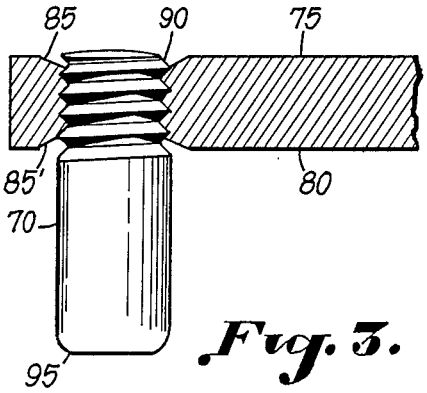
FIG. 3 is a detailed cross-sectional view along line 3—3 of FIG. 2.
Figure 2:
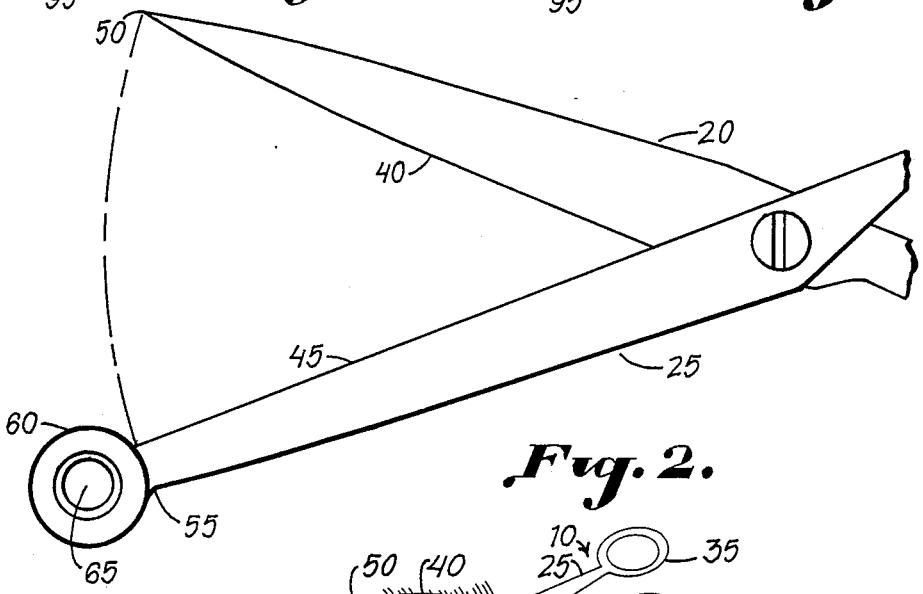
FIG. 2 is a top plan view of the improved shears.
Figure 1:
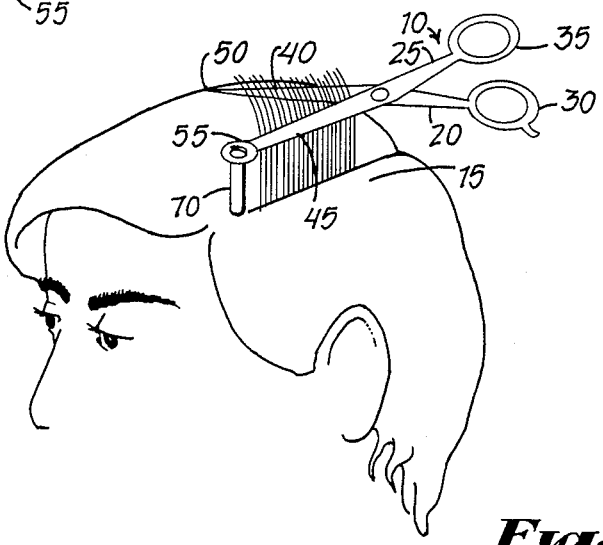
FIG. 1 is a perspective view of the improved shears in relation to the scalp of the person whose hair is being cut.

Referring to FIG. 1, a preferred embodiment is disclosed which shows an improved shears 10 positioned above a scalp 15 of the person whose hair is to be cut. Shears 10 comprise two members 20, 25, having looped ends 30, 35 for receiving an index finger and thumb of a hand, and blades 40, 45 with tips 50, 55 opposite looped ends 35,30. respectively. The two members 20,25 are joined pivotally approximately halfway between blade tip 50,55 and looped ends 35,30. When looped ends 35,30 are closed by the fingers, blades 40,45 come together to shear the hair.

One the end of tip 55 is an extension 60, enlarged, drilled through and tapped to form a threaded hole 65 for receiving a post 70. Extension 60 has a top surface 75 and an opposing bottom surface 80. The edges 85, 85' of hole 65 at top surface 75 and bottom surface 80 are beveled to facilitate quick and easy insertion of post 70 from either top surface 75 or bottom surface 80.

Post 70 has a threaded end 90 which mates with the threads of hole 65, and a smooth end 95 for placing against scalp 15.

A plurality of posts 70 of differing lengths can be used to make cuts of differing lengths by unscrewing one post 70 and replacing it with a longer or shorter post 70. Alternatively, the threaded end 90 of post 70 can be longer to allow post 70 to be advanced more or less through hole 65 of extension 60. A wing nut 100 can be used to secure post 70 in hole 65.

Although the shears 10 and extension 60 are normally made of metal, post 70 can be made of any metal, ceramic, plastic or rubberized material that provides reasonable linear dimensional stability. A limited amount of flexibility or cushioning in Post 70 is desirable.

Although post 70 is preferably threadably secured to shears 10, alternate securing means is possible, such as a series of ball detents on post 70.

The threads of the threaded end 90 of post 70 and threaded hole 65 are preferably coarse so that fewer turns are required to seat post 70 in hole 65 thereby facilitating the quick and easy advancing or post 70 or removal and installation of other length posts 70.

It is most important that the post be affixed to tip 55 of shears 10 rather than close to either looped end 30 or 35 since the effect of movement of looped ends 30, 35 on blades 40, 45 is minimized when post 70 is removed as much as possible from looped ends 30, 35 and tip 55 is steadied on scalp 15.

The foregoing description of the preferred embodiment of the invention has been presented for purposes of illustration and description. It is not intended to be exhaustive or to limit the invention to the precise form disclosed, and obviously many modifications and variations are possible in light of the above teachings. The embodiments were chosen and described in order to best explain the principles of the invention and its practical application to thereby enable one skilled in the art to best utilize the invention in various embodiments and with various modifications as are suited to the particular use contemplated. It is intended that the scope of the invention be defined by the claims appended hereto.

I claim:

1. An improvement in hair cutting shears having two opposing members, each of said members having a looped end and a blade having a tip at the opposite end of said member, said members pivotally joined approximately midway along their lengths so that when said finger loops are brought together said blades close to cut any hair therebetween wherein the improvement comprises an extension of the tip of one of said blades, said tip extension having a threaded hole therethrough, an upper surface and a lower surface;

a post means having a smooth end for resting against the scalp of person whose hair is to be cut and a threaded opposing end, said threaded end mating with said threaded hole in said tip extension so that said post means depends from said lower surface of said tip extension and, when said post means is resting on the scalp of the person whose hair is to be cut, said distance between said scalp and said shears may be accurately and steadily maintained for cutting.

2. The improvement of claim 1 wherein said threaded hole and said threaded end of said post means are coarsely threaded so that said post means may be quickly and easily advanced in said threaded hole.

3. The improvement of claim 2 wherein said hole has beveled edges at said upper surface and said lower surface so that said post means may be easily and quickly inserted from either said upper surface or said lower surface.

* * * * *